US005207622A

United States Patent [19]

Wilkinson et al.

[11] Patent Number: 5,207,622

[45] Date of Patent: May 4, 1993

[54] UNIVERSALLY ADAPTABLE ADJUSTABLE ARM EXERCISE DEVICE TO SUPPLEMENT LEG EXERCISING

[75] Inventors: William T. Wilkinson, 300 Kyle Rd., Crownsville, Md. 21032-0572; John J. Nelson, Levitown, Pa.

[73] Assignee: William T. Wilkinson, Crownsville, Md.

[21] Appl. No.: 945,373

[22] Filed: Sep. 16, 1992

[51] Int. Cl.[5] ..... A63B 22/02; A63B 21/015

[52] U.S. Cl. ..... 482/54; 482/118

[58] Field of Search ..... 482/54, 72, 51, 114, 482/118, 115

[56] References Cited

U.S. PATENT DOCUMENTS 3,904,196 9/1975 Berlin ..... 482/118
4,709,918 12/1987 Grinblat ..... 482/72
4,826,152 5/1989 Lo ..... 482/114
5,110,117 5/1992 Fisher et al. ..... 482/72

*Primary Examiner*—Stephen R. Crow
*Attorney, Agent, or Firm*—Connolly & Hutz

[57] ABSTRACT

A universally adaptable adjustable arm exercise device to supplement leg exercising includes a leg exercising unit having a foot contact surface. A pole is mounted adjacent each of two opposite sides of the foot contact surface. The mounting is accomplished by each pole being mounted to a mounting bracket secured to the leg exercise unit. A hinge pin extends from each bracket with a respective pole pivotally mounted to one of the hinge pins. An adjustable resistance device is provided on each of the hinge pins with a resistance setting member on each hinge pin for controlling the resistance force required for a user to pivot the poles back and forth and thereby provide an arm exercise simultaneously with the use of the leg exercise unit.

24 Claims, 5 Drawing Sheets

Fig. 1A.
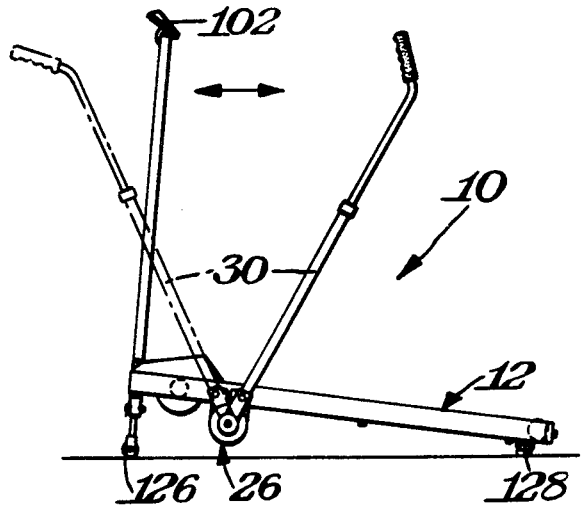
Fig. 1.
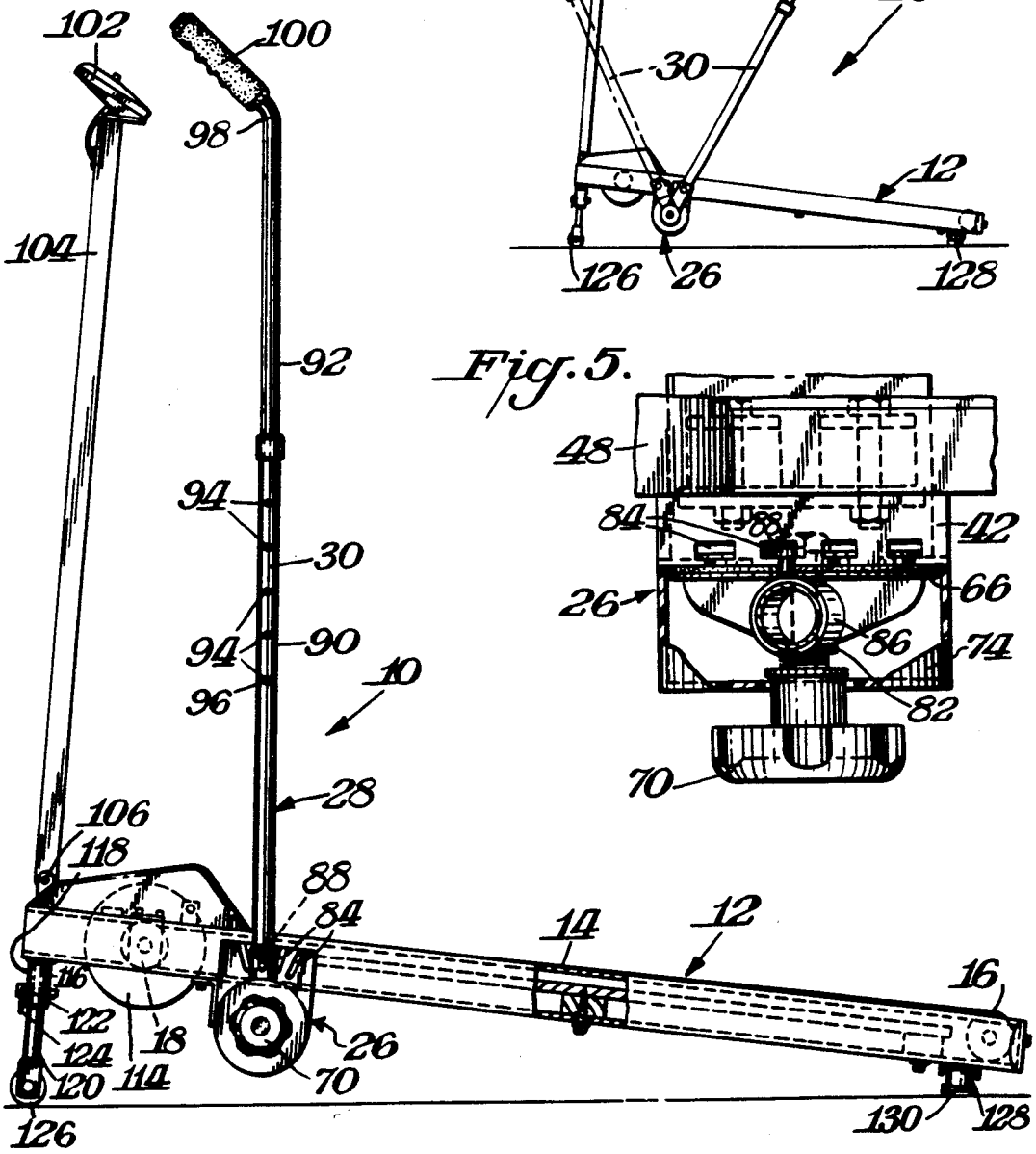
Fig. 5.

UNIVERSALLY ADAPTABLE ADJUSTABLE ARM EXERCISE DEVICE TO SUPPLEMENT LEG EXERCISING

BACKGROUND OF THE INVENTION

Currently there is an increasing emphasis on aerobic exercise. Many types of machines have been devised to provide the user with simulated types of exercise. At the same time there has also been a trend for total body exercise. This has led to the provision of various dual action machines to exercise both the a and the legs. An example is found in U.S. Pat. No. 5,110,117 which provides a treadmill with pivoting handles. Most of the commercial machines, however, exercise just the legs and not the arms. Often the leg exercise units include a balance rail or bar which could be held by the user's hands during the leg exercise.

There is a need for a device which could effectively exercise the arms to provide an upper body dimension for both new and existing aerobic exercise machines. An ideal device would include the features of either being permanently or detachably mounted to the aerobic exercise machine which provides the ability to have a leg exercise. Additionally, such device should be adaptable in many different types and sizes of aerobic exercise devices. Further, such device should be adjustable in the height/length of the poles so as to accommodate different size people. Still further the device should have adjustable tension to vary the level of workout. Such device should also have adjustable pole positions and comfortable hand grips as well as adjustable hand grips.

SUMMARY OF THE INVENTION

An object of this invention is to provide a universally adaptable adjustable arm exercise device which fulfills the above needs by supplementing leg exercises in aerobic workouts.

A further object of this invention is to provide such a device which may be used with various types of leg exercise units such as treadmills.

A still further object of this invention is to provide such a device which could be easily detachably mounted to a leg exercise unit, such as a treadmill, so that owners of existing leg exercise units need only mount the arm exercise device to the unit to achieve a total body workout.

In accordance with this invention, the universally adaptable adjustable arm exercise device for supplementing leg exercising includes a leg exercise unit having a foot contact surface, such as a treadmill. A pole is mounted on each side of the foot contact surface by means of a mounting bracket having a hinge pin extending from each bracket so that the respective pole may be pivotally secured to a respective hinge pin. Adjustable resistance means is provided on each of the hinge pins with an adjustable resistance setting member on each of the hinge pins for controlling the resistance force of the resistance means and thereby control the force required by a user to pivot the poles back and forth thus providing an arm exercise simultaneously with the leg exercise unit.

In the preferred practice of this invention the resistance means is a resistance plate or brake disk mounted between the pole and the bracket with the resistance setting member being a knob on the hinge pin for tightening or loosening the mounting of the pole against the bracket.

The pole and bracket may include complementary means to selectively mount the poles in a rigid nonpivoting position when it is desired to use the poles for balance purposes during use of the leg exercise unit.

In a preferred practice of the invention each mounting bracket is detachably mounted to the leg exercise unit so that the device can be added to existing leg exercise units. The detachable mounting may be accomplished by providing frames slidably mounted on rods for movement toward and away from each other thereby varying the distance between the mounting brackets.

The device may include a column having an electronic unit mounted at the top of the column for indicating various parameters indicative of the aerobic exercise.

In the preferred practice of the invention the poles are mounted in such a manner that the poles can be moved toward their stored position by being disposed generally in line with the foot contact surface, such as the belt or rollers of a treadmill. Similarly, the electronic unit column may be pivotally mounted for being disposed in line with the foot contact surface so as to provide a collapsed unit of compact size which facilitates the storage and transportation of the device. Transportation of the device may also be facilitated by providing legs on the device with wheels or rollers at the end of each leg thereby permitting the device to be rolled on end to its desired location.

THE DRAWINGS

FIG. 1 is a front elevational view of a universally adaptable adjustable arm exercise device in accordance with this invention shown in the locked condition;

FIG. 1A is a view similar to FIG. 1 showing the device in the pole movement condition;

FIG. 5 is a plan view partly in section of a portion of the device shown in FIGS. 1-4;

DETAILED DESCRIPTION

Figure 2:
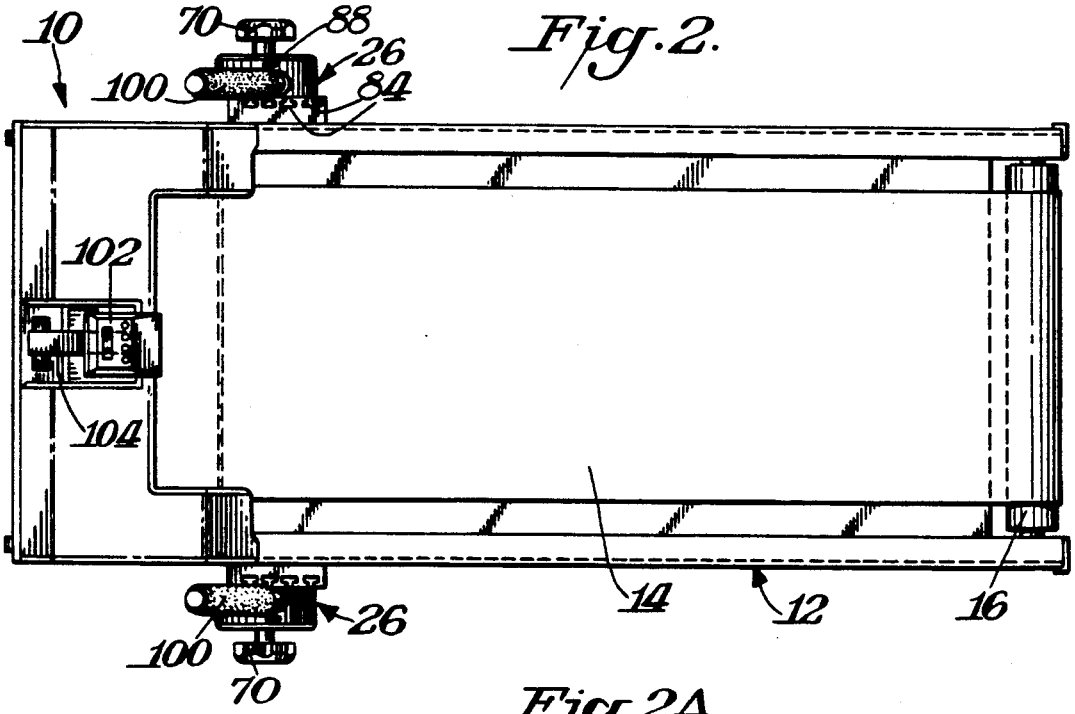
FIG. 2 is a top plan view of the device shown in FIG. 1 in the form of a treadmill having a belt with no rollers.

The present invention is intended to provide a universally adaptable adjustable arm exercise device which supplements aerobic exercises such as leg exercising. In general, the device includes a pair of poles which would be held by the user's hands and which could selectively be pivoted to provide an arm exercise simultaneously with the leg exercise or when desired to simply provide balance while doing the leg exercise. It is to be understood that the invention is intended to complement various forms of aerobic exercise units, particularly leg exercise units. For illustrative purposes the leg exercise units shown and described are forms of treadmills. The invention, however, may be practiced with other types of units including an XC ski machine, stationary bikes in either upright or incumbent form, steppers/step climbers, trampolines, rowers, chairs and benches. Although such devices such as XC ski machines and rowers have an upper body exercise mechanism, the present invention provides a different type or form of arm exercise than provided by such exercise unit. It is also to be understood that the arm exercise device could be mounted on various structures where all that is intended is to provide an upper body exercise or running in place.

The drawings illustrate one manner of practicing this invention. As shown therein the exercise device 10 includes a leg exercising unit in the form of a treadmill 12. Treadmill 12 may be of any suitable known construction. For example, as illustrated treadmill 12 includes an endless belt 14 mounted for movement over rollers 16,18 at opposite ends thereof spaced over a support member 20 in frame 22. Front roller 18 is motor driven as is known in the art. FIG. 2B for example schematically illustrates the inclusion of motor M.

Figure 2A:
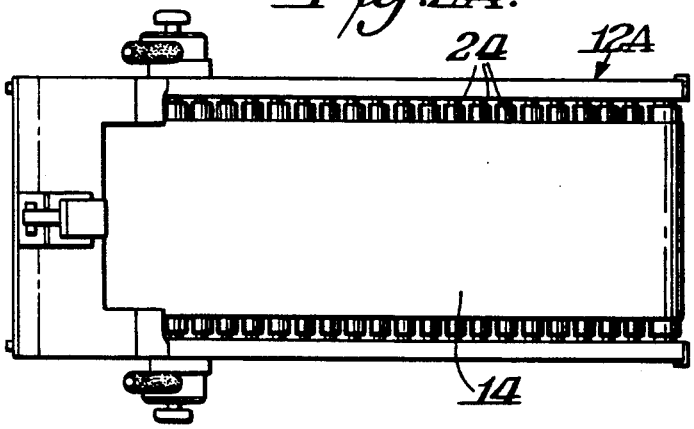
FIG. 2A is a view similar to FIG. 2 showing the treadmill in the form of a belt and rollers.
Figure 2B:
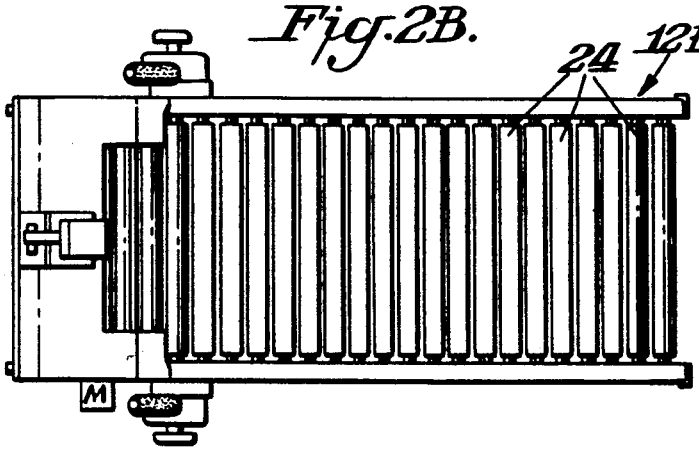
FIG. 2B is a view similar to FIGS. 2 and 2A showing the treadmill having rollers and no belt.

FIG. 2 illustrates one variation of treadmill 12 wherein the foot contact surface is belt 14. FIG. 2A illustrates a variation of treadmill 12A which includes a plurality of individual rollers 24 disposed below belt 14. This represents the preferred form of treadmill. FIG. 2B illustrates a further variation wherein the foot contact surface is the plurality of rollers 24 without there being any superimposed belt.

In accordance with this invention an arm exercise frame 26 having arm exercise unit 28 is mounted to treadmill frame 22. As later described in the preferred practice of this invention arm exercise frame 26 is adjustable in width and detachably mounted to treadmill frame 22 so as to be adapted to fit o various size treadmills.

The arm exercise unit 28 includes a pair of poles 30,30 with each pole being mounted at a respective side of treadmill frame 22.

Figure 3:
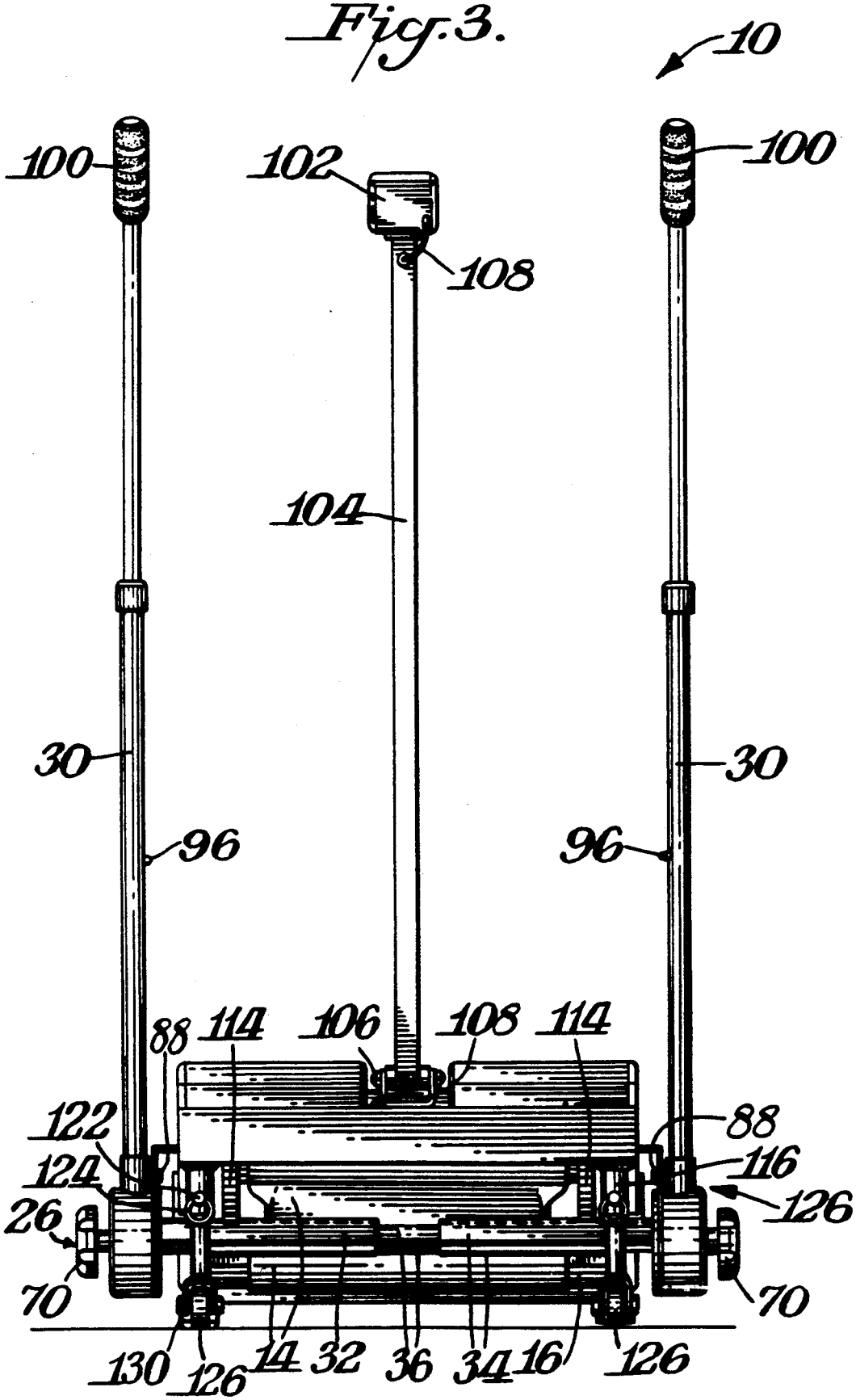
FIG. 3 is a rear elevational view of the device shown in FIG. 1.
Figure 4:
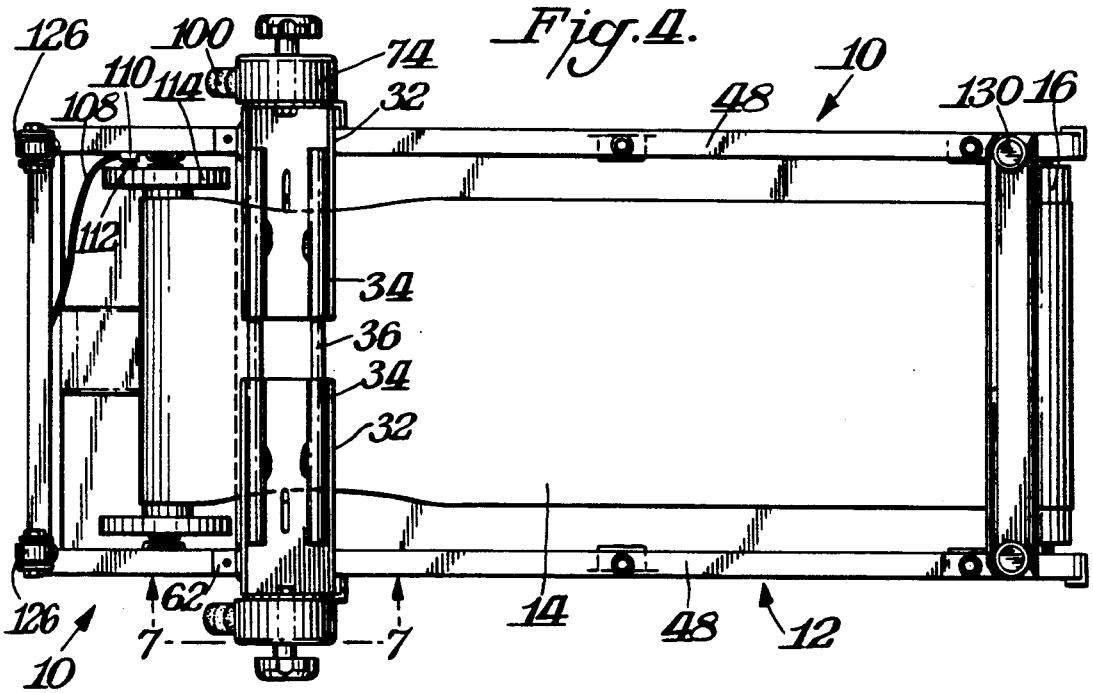
FIG. 4 is a bottom plan view of the device shown in FIGS. 1 and 3.
Figure 7:
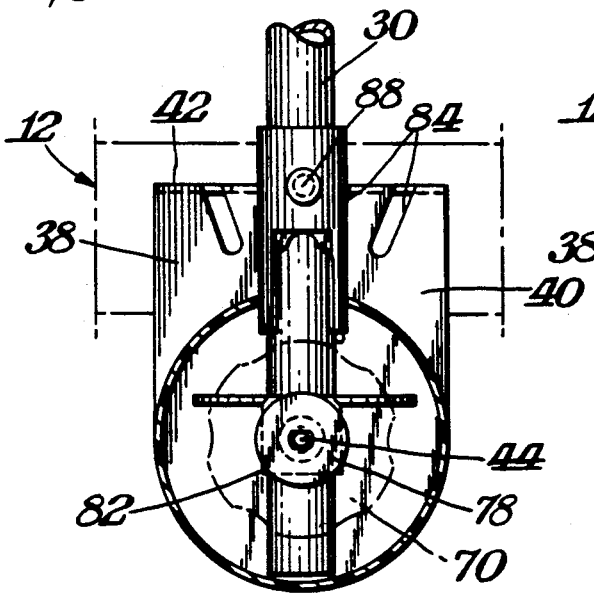
FIG. 7 is a cross-sectional view taken through FIG. 4 along the line 7—7.
Figure 8:
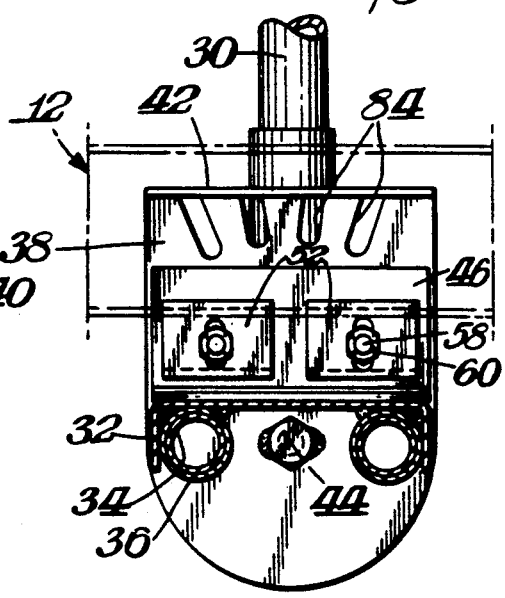
FIG. 8 is a cross-sectional view showing the rear portion of the device shown in FIG. 7.

As previously indicated in the preferred practice of this invention the arm exercise frame 26 is detachably mounted to the treadmill frame 22. This detachable mounting is based upon the principal of clamping the arm exercise frame 26 to the treadmill frame 22 which is facilitated by having the arm exercise frame adjustable in width. As illustrated in FIGS. 3 and 4 arm exercise frame 26 includes a pair of base members 32 which are in the form of an inverted U. A tube 34 is rigidly connected as by welding to each of the legs of the respective base members 32 so that four fixed tubes thereby result. A telescopic tube 36 is inserted in each pair of aligned fixed tubes 34 to permit the base member to be moved toward and away from each other and thereby adjust the width of frame 26.

Figure 6:
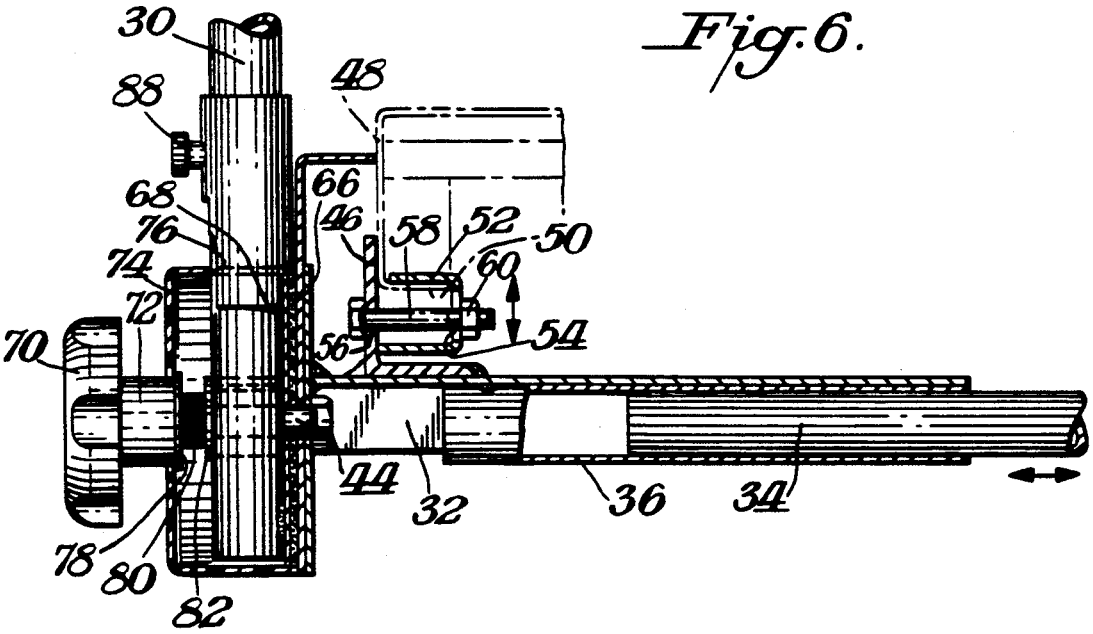
FIG. 6 is a side view partly in section of a portion of the device shown in FIGS. 1-5.

Each base member 32 includes a plate-like bracket mount 38 which has an elongated vertical side 40 and an inwardly turned perpendicular horizontal side 42. The horizontal side 42 abuts against frame 22 of treadmill 12. A hinge shaft 44 extends perpendicularly outwardly from vertical side 40 of bracket 38 as best seen in FIG. 6. Shaft 44 may be in the form of a rod having a smooth inner portion and terminating in a threaded end.

An L-shaped mounting member 46 is secured inwardly of bracket 38 by being mounted to the top of U-shaped base member 32. The treadmill frame 22 includes a vertical wall 48 parallel to mounting bracket 38. Vertical wall 48 terminates in an inwardly turned flange 50. A U-shaped bracket 52 rests on flange 50. Bracket 52 has a hole 54 in line with a hole 56 in L-shaped bracket 46. A bolt 58 extends through the aligned holes and locks brackets 46 and 50 together by nut 60. This locking action also detachably mounts arm unit frame 26 to treadmill frame 22. For stability purposes a pair of U-shaped brackets 50 are provided at each L-shaped bracket 46.

For further detachable securement of frame 26 to treadmill frame 22 an L-shaped bracket 62 is provided which is fixedly secured as by welding to base member 32 and detachably mounted to flange 50 of treadmill frame 22 by any suitable fasteners such as bolts 64 having nuts secured thereto. The L-shaped brackets 62 are shown for example in FIGS. 1 and 4.

Each pole 30 is pivotally mounted on a respective hinge shaft 44 as shown for example in FIG. 6. As also shown therein a brake disk or resistance plate 66 is mounted on shaft 44 between the disk member 68 secured to pole 30 and bracket 38. The degree of contact between pole disk 68 and resistance plate or disk 66 will determine the amount of force necessary for the user to pivot each pole during the arm exercise.

As also shown in FIG. 6 a knob 70 is threadably engaged with the threaded outer end of shaft 44. Knob 70 includes an inward boss 72 which is internally threaded and serves for the connection to shaft 44. Boss 72 extends through cup-like housing 74 mounted against bracket 38. Housing 74 includes a slot 76 through which pole 30 extends. Mounted on shaft 44 between boss 72 and pole 30 are a keywasher 78 having an oblong or slotted opening with a series of spring washers 80 disposed against keywasher 78. Next a flat washer then a thrust bearing and then another flat washer are mounted on shaft 44 against a U-shaped extension 82 which extends from pole disk 68.

As can be appreciated the frame 26 thus operates in a clamping manner to firmly lock onto various size frames of leg exercise units, such as the frame of treadmill 12. The arm unit frame 26 is disposed essentially underneath the frame 22 of the exercise device 12 and spans its width so that frame 26 runs from side to side and provides a pole 30 for each arm of the user. The clamp mechanism is designed to provide a very firm mount and to resist any forward/backward motion so that the user will get a smooth motion when using poles 30 over a fixed range with full exercise benefit.

When it is desired to adjust the force or resistance necessary for the user to move the poles 30 all that need be done is to rotate the knobs 70 clockwise or counterclockwise to increase or decrease the resistance.

FIG. 1A illustrates the poles 30 in solid lines and in phantom during the arm exercise.

Another feature of mounting bracket 38 is the inclusion of a plurality of slots 84 which extend into the top wall 42 and front face 40 of bracket 38. The slots 84 permit each pole to be mounted in a locked condition at a desired orientation when it is intended to have the pole function to provide balance to the user such as when the user performs a leg exercise without simultaneously performing an arm exercise. In order to achieve this adjustable locking condition each pole includes a sliding collar 86 which can freely rotate and be moved up and down on pole 30 by the user. Each collar 86 carries a pin 88 in the form of a T which is dimensioned to fit in the T-shaped slots 84. Since four slots 84 are provided four different locations are possible. It is to be accordance with the number of slots 84.

When it is desired to inactivate or lock the poles in a fixed position, the user rotates collar 86 and pivots pole 30 so that the locking pin 88 is disposed in line with the desired slot 84. The user then slides collar 86 down pole 30 until the locking pin 88 enters the appropriate slot thus preventing any rotational movement of pole 30. FIG. 5 illustrates on an enlarged scale locking pin 88 disposed in a T-shaped slot 84.

A further feature of this invention is the various adjustability to the poles 30 from a length and orientation standpoint. As illustrated for example, pole 30 is in the form of an outer tube 90 and an inner tube 92 telescopically positioned in tube 90. Columns of holes 94 are disposed around the periphery of outer tube 90. The various columns are staggered with respect to each other to provide greater height selectivity. Inner pole 92 includes a spring biased locking pin 96 which would engage a selective hole 94. FIG. 1, for example, illustrates pole 30 when the locking pin 96 is in the uppermost hole 94. By providing sets of holes around the periphery it is not only possible to adjust the height of pole 30, but also its angular orientation. In this respect, the poles have a bent portion 98 with foam grips 100 to facilitate the comfort in use of the poles. The bent portions of poles 3 provide better ergonometric design. The telescoping action and sets of vertically spaced and peripherally spaced holes permits poles 30 to be adjusted to accommodate various sizes of people and various types of machines.

A further feature of device 10 is the inclusion of an electronic readout mechanism 102 to provide various readings to the user to indicate the type of exercise being performed. Such devices are known in the art and might include, for example, a timer, a speed indicator, a speed selector, a reset, a stop and various other known indicating means. As illustrated, the read out unit 102 is mounted to the top of column 104 which is pivotally connected to frame 22 by pivot pin 104. The various figures illustrate the electrical wiring 108 for reading unit 102. See, for example, FIGS. 3 and 4.

FIG. 4 also illustrates the inclusion of a suitable sensor 110 mounted to frame 22. A fly wheel 114 includes a magnetic member 112 which is sensed each time it passes sensor 110 to provide a count of the number of revolutions of the fly wheel 114 so as to provide the user with a read out indicative of the speed and/or distance that the treadmill 12 is being used.

A further feature of device 10 is the inclusion of adjustable legs 116 at the front end of frame 22. Legs 116 may be of any suitable form such as including an outer tube 118 into which an inner tube 120 is telescopically mounted. Outer tube 118 would have a pair of aligned openings through which a locked pin 122 may be inserted. Inner tube 120 would have a series of vertical holes extending therethrough so that the locked pin could extend through the holes in locked tube 118 and the appropriate hole of inner tube 120, thus providing height adjustment to the legs 116. To facilitate manipulation of lock pin 122 a ring 124 is provided for each lock pin 122 by the ring 124 extending through holes in lock pin 122 so that the ring 124 is freely mounted. Wheel or roller 126 is provided on the remote end of each leg 116 to facilitate moving device 10. The rear end of treadmill frame 122 includes a set of fixed legs 128 having pads 130 made from rubber or any other suitable material.

When it is desired to store device 10 the various parts of device 10 may be manipulated so that the resulting assembly is of compact easy to remove size. For example, poles 30 would be manipulated so that the inner tubes 92 are retracted into outer tubes 90 the full extent. Poles 30 would then be rotated so as to be disposed along side treadmill frame 122. The nut on the end of threaded hinge pin 106 for column 104 would be loosened so that column 104 could be rotated against belt 14. Legs 116 would be manipulated to extend inner tube 120 the full extent into outer tube 118. In this compact position frame 22 may be grasped by the user such as at roller 16 to lift the folded unit which may then be wheeled on wheels or rollers 126.

As previously indicated the preferred practice of this invention is to provide the arm exercise unit as a detachable unit and more particularly one that is adjustable in width so that the arm exercise unit 28 could be mounted on any existing leg exercise unit such as a treadmill 12. It is to be understood, however, that the invention may be practiced where the arm exercise unit is fixedly mounted rather than detachably mounted to the leg exercise unit. Such fixed mounting would be of simpler construction in avoiding the need for width adjustability and the other components necessary for the detachable mounting. Such practice of the invention, however, would not have the advantage of being able to be detached and mounted to any leg exercise unit.

It is also to be understood that where poles 30 are used solely to provide balance to the user while the user does a leg exercise or other aerobic exercise, it is not necessary that both poles be disposed in the same orientation. Thus, the angular orientation of the tube poles may be varied by varying the slot 84 selected for engagement by the respective locking pin 88. Similarly, the rotation orientation of each pole and the length of each pole may be varied with respect to each other by the selection of the appropriate hole for locking pin 96.

The arm exercise device thus provides a unit which could fit on an aerobic exercise machine to give an upper body or total body exercise. As noted, such aerobic exercise machines are not limited to treadmills and could include such other devices as XC ski machines, bicycles and steppers. The arm exercise unit is adapted to the permanently or detachably mounted to any such aerobic exercise machine. In the broad practice of this invention wherein the arm exercise unit is detachably mounted such detachable mounting could include one or more detachable brackets/posts that fit on handle bars, handle bar posts, bike frames, treadmill side frames, treadmill front or back frames, stepper hand rails, stepper frames or on a base plate underneath a particular aerobic exercise machine. As can be appreciated the poles 30 are totally adjustable by providing various heights and various orientations for proper balance and for also providing the ability of the poles to swing free for use in an arm exercise. The provision of one or more tension adjustments also advantageously provides for a various adjustable workout resistance range. The ability of the poles and particularly the top handles to rotate a full 360° and be locked at various positions permits the accommodation of different users and thus achieves an individualized comfort or feel. In the preferred form of the invention the poles terminate in a bent portion. The invention, however, may be practiced where the poles are completely straight.

Device 10 not only provides an effective total exercise device, but also lends itself to easy transportability and storage. This is achieved by the ability to be able to fold the poles and column adjacent to or against the treadmill frame. The provision of the adjustable legs 116 at the end of frame 22 not only provides a ready location for wheels which facilitates transporting the folded device 10 in its compact form, but also the extended length of legs 116 provide a support or base to permit the folded device 10 to be stored in an upright condition with the treadmill frame vertically disposed supported by legs 116.

What is claimed is:

1. A universally adaptable adjustable arm exercise device to supplement leg exercising comprising a leg exercise unit having a foot contact surface, a pair of poles, each of said poles being mounted adjacent said foot contact surface with said foot contact surface being between said poles, each of said poles having a mounting bracket, each of said mounting brackets being detachably mounted to said leg exercise unit, a hinge shaft extending from each of said mounting brackets, each of said poles being pivotally mounted to a respective one of said hinge shafts, adjustable resistance means on each of said hinge shafts, and a resistance setting member on each said hinge shafts for controlling the resistance force of said resistance means to thereby control the force required by a user to pivot said poles back and forth to provide for an arm exercise simultaneously with the use of said leg exercise unit.

2. The device of claim 1 wherein said resistance means includes a frictional resistance plate mounted between said pole and said bracket, and said resistance setting member being movably mounted on said hinge shaft for controlling the resistance offered by said resistance plate in accordance with the distance between said pole and said bracket.

3. The device of claim 2 including locking means for maintaining said poles in a rigid position by preventing the pivotal movement of said poles whereby said poles function as balance means of the user while the user performs the leg exercise.

4. The device of claim 3 wherein said means for maintaining said poles rigid includes means for providing a plurality of selected angular orientations of said poles.

5. The device of claim 4 wherein said means for making said poles rigid includes a plurality of slots in said bracket, a collar on said pole, said collar being rotatably and slidably mounted on said pole, and a locking pin on said collar for selective engagement with one of said slots.

6. The device of claim 5 wherein each of said poles comprises a pair of telescopically arranged tube members for providing height adjustability of said pole, said pole including a gripping member at its end remote from said hinge shaft, said tubular members being rotatably telescopically mounted with respect to each other, a plurality of holes in the outer of said tubular members, said plurality of said tubular holes being arranged in columns around the periphery of said outer tubular member, and a spring loaded locking pin on said inner tubular member for selective engagement in one of said holes of said outer tubular member.

7. The device of claim 6 wherein said resistance means further includes a disk member mounted on said pole in surface contact with said resistance plate, said shaft terminating in a threaded end, and said resistance setting member comprising a knob threadably engaged on said shaft for controlling the degree of said contact between said resistance plate and said pole disks.

8. The device of claim 1 wherein the distance between said mounting brackets may be adjusted to adapt said mounting brackets and said poles to be mounted to different size leg exercise units.

9. The device of claim 8 including a frame connected to each of said mounting brackets and disposed under said leg exercise unit, each of said frames including a pair of rigid passage members aligned with each other, and a tube extending telescopically into each pair of aligned passage members to mount said frames together.

10. The device of claim 9 wherein said exercise unit is a treadmill.

11. The device of claim 10 wherein said foot contact surface is an endless belt.

12. The device of claim 11 including a plurality of rollers mounted under said endless belt.

13. The device of claim 10 wherein said foot contact surface is the peripheral surface of a plurality of rollers.

14. The device of claim 10 including an electronic readout unit for indicating exercise parameters.

15. The device of claim 14 wherein said electronic readout unit is mounted on a column secured to said treadmill.

16. The device of claim 10 wherein said poles are capable of being pivoted to be generally in line with said foot contact surface of said treadmill to permit said device to be collapsed for storage and transportability.

17. The device of claim 16 including an electronic readout unit for providing exercise parameters to the user, said electronic readout unit being mounted on a column, and said column being pivotally connected to said treadmill whereby said column may be pivoted against said foot contact surface when said device is in its collapsed position.

18. The device of claim 17 including a set of legs at one end of said treadmill.

19. The device of claim 18 wherein the height of said legs is adjustable to vary the inclination of said treadmill, and said legs providing support means for mounting said device on its end in its collapsed stored and transportable condition.

20. The device of claim 3 wherein said exercise unit is a treadmill.

21. The device of claim 20 wherein said poles are capable of being pivoted to be generally in line with said foot contact surface of said treadmill to permit said device to be collapsed for storage and transportability.

22. The device of claim 21 including an electronic readout unit for providing exercise parameters to the user, said electronic readout unit being mounted on a column, and said column being pivotally connected to said treadmill whereby said column may be pivoted against said foot contact surface when said device is in its collapsed position.

23. The device of claim 22 including a set of legs at one end of said treadmill.

24. The device of claim 23 wherein the height of said legs is adjustable to vary the inclination of said treadmill, and said legs providing support means for mounting said device on its end in its collapsed stored and transportable condition.

* * * * *